US008001949B2

(12) United States Patent
Savvakis

(10) Patent No.: US 8,001,949 B2
(45) Date of Patent: Aug. 23, 2011

(54) INTERNAL COMBUSTION ENGINE

(76) Inventor: Savvas Savvakis, Thessaloniki (GR)

( * ) Notice: Subject to any disclaimer, the term of this patent is extended or adjusted under 35 U.S.C. 154(b) by 729 days.

(21) Appl. No.: 11/996,512

(22) PCT Filed: Jun. 2, 2006

(86) PCT No.: PCT/GR2006/000027

§ 371 (c)(1),
(2), (4) Date: Jan. 23, 2008

(87) PCT Pub. No.: WO2007/015114

PCT Pub. Date: Feb. 8, 2007

(65) Prior Publication Data

US 2008/0196688 A1 Aug. 21, 2008

(30) Foreign Application Priority Data

Aug. 1, 2005 (GR) ..... 20050100405
Jun. 2, 2006 (WO) ..... PCT/GR2006/000027

(51) Int. Cl.

| | |
|---|---|
| ***F02B 53/00*** | (2006.01) |
| ***F02B 53/08*** | (2006.01) |
| ***F01C 1/34*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/245; 123/236; 123/18 R; 418/33

(58) Field of Classification Search ..... 123/236–237, 123/239, 241, 245, 18 R, 47 R; 418/35–38; *F02B 53/00, 53/02, 53/08, 53/10, 53/12; F01C 1/34*
See application file for complete search history.

(56) References Cited

U.S. PATENT DOCUMENTS

| | | | | |
|---|---|---|---|---|
| 1,916,318 | A * | 7/1933 | Huber | 123/237 |
| 2,075,654 | A * | 3/1937 | Martin | 418/33 |
| 3,556,694 | A * | 1/1971 | Bancroft | 418/37 |
| 3,989,011 | A * | 11/1976 | Takahashi | 123/204 |
| 5,251,595 | A | 10/1993 | Wei-Min et al. | 123/237 |
| 6,257,195 | B1 * | 7/2001 | Vanmoor | 123/239 |
| 6,606,973 | B2 * | 8/2003 | Moe | 123/228 |
| 6,662,774 | B1 * | 12/2003 | Toll | 123/236 |
| 6,880,494 | B2 * | 4/2005 | Hoose | 123/18 A |
| 6,959,685 | B2 * | 11/2005 | Person et al. | 123/236 |
| 2007/0181101 | A1 * | 8/2007 | Tardif | 123/45 R |
| 2009/0194065 | A1 * | 8/2009 | Okamura | 123/245 |
| 2010/0012078 | A1 * | 1/2010 | Cerruti et al. | 123/244 |

FOREIGN PATENT DOCUMENTS

| | | | |
|---|---|---|---|
| CA | 1304692 C | * | 7/1992 |
| DE | 2945187 A1 | | 7/1980 |
| DE | 4304423 A1 | * | 8/1994 |

(Continued)

*Primary Examiner* — Thai Ba Trieu
(74) *Attorney, Agent, or Firm* — David A. Guerra

(57) ABSTRACT

An engine with expansion piston located on the end of a motion arm connected to the engine shaft. On the shaft, rotating compression pistons are mounted. The distance between the two piston types allows for the production of great torque. The geometry of expansion chamber and compression chamber is concentric toroidal. A pressure chamber stores the air-fuel mixture coming from the compression chamber to the expansion chamber and is therefore interposed between the two. The timing of the two or more sliding ports attached to the compression chambers determines the compression volume, while the valves control the communication of the pressure chamber with the other chambers.

20 Claims, 15 Drawing Sheets

FOREIGN PATENT DOCUMENTS

| | | | | |
|---|---|---|---|---|
| DE | 19954480 | A1 | | 5/2001 |
| EP | 0085427 | A | | 8/1983 |
| GB | 267490 | A | * | 9/1927 |
| GB | 1296769 | A | * | 11/1972 |
| JP | 58206827 | A | * | 12/1983 |
| JP | 63227927 | A | * | 9/1988 |
| WO | WO 9822698 | A1 | * | 5/1998 |
| WO | WO 2006072820 | A2 | * | 7/2006 |

* cited by examiner

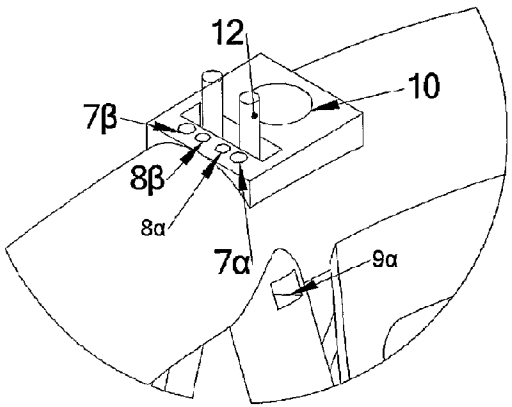
Figure 3: Detail A
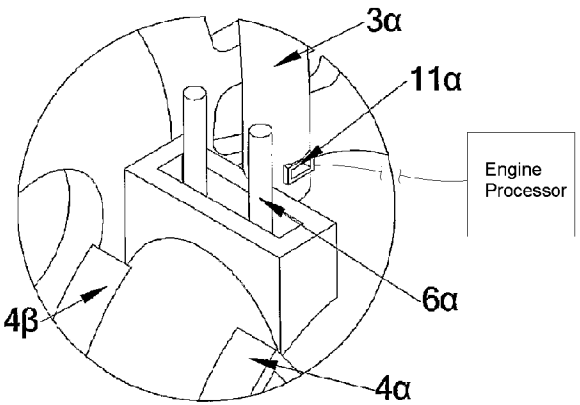
Figure 4: Detail B
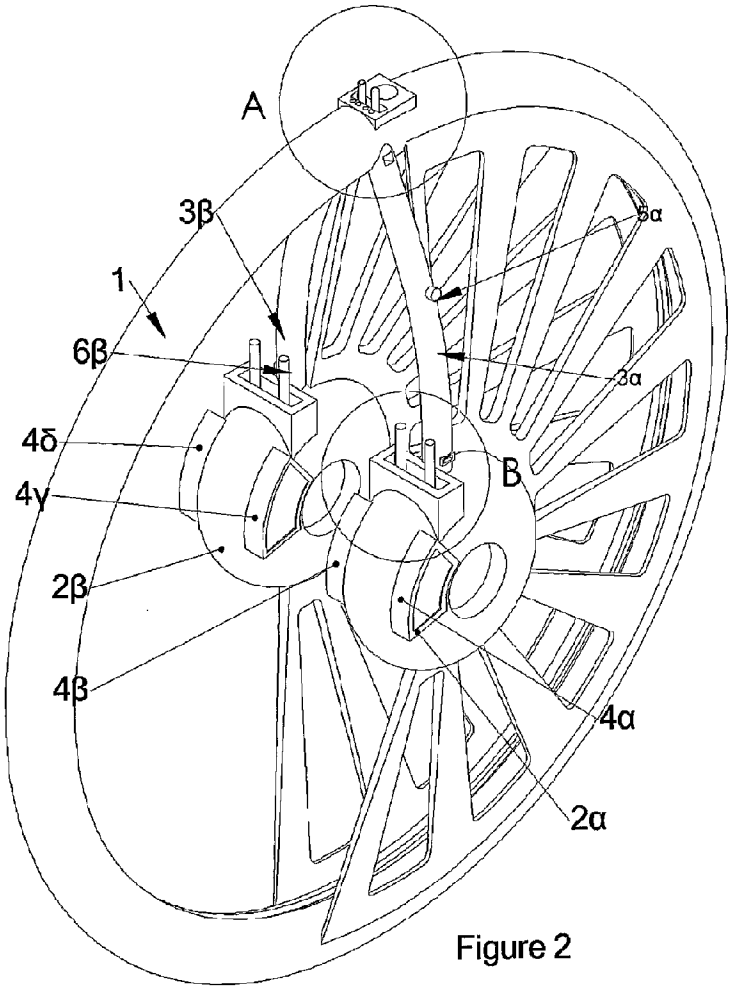
Figure 2

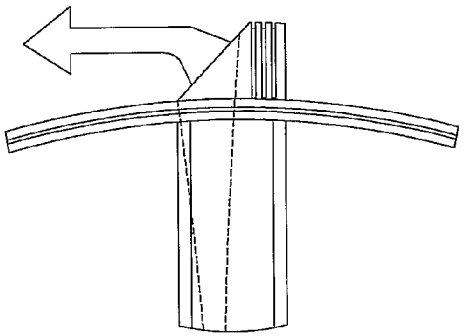
Figure 18: Detail A
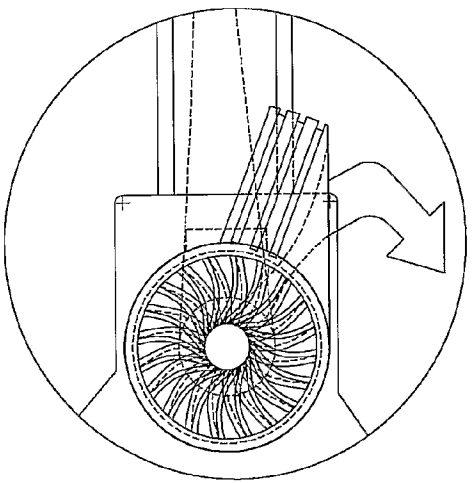
Figure 19: Detail B
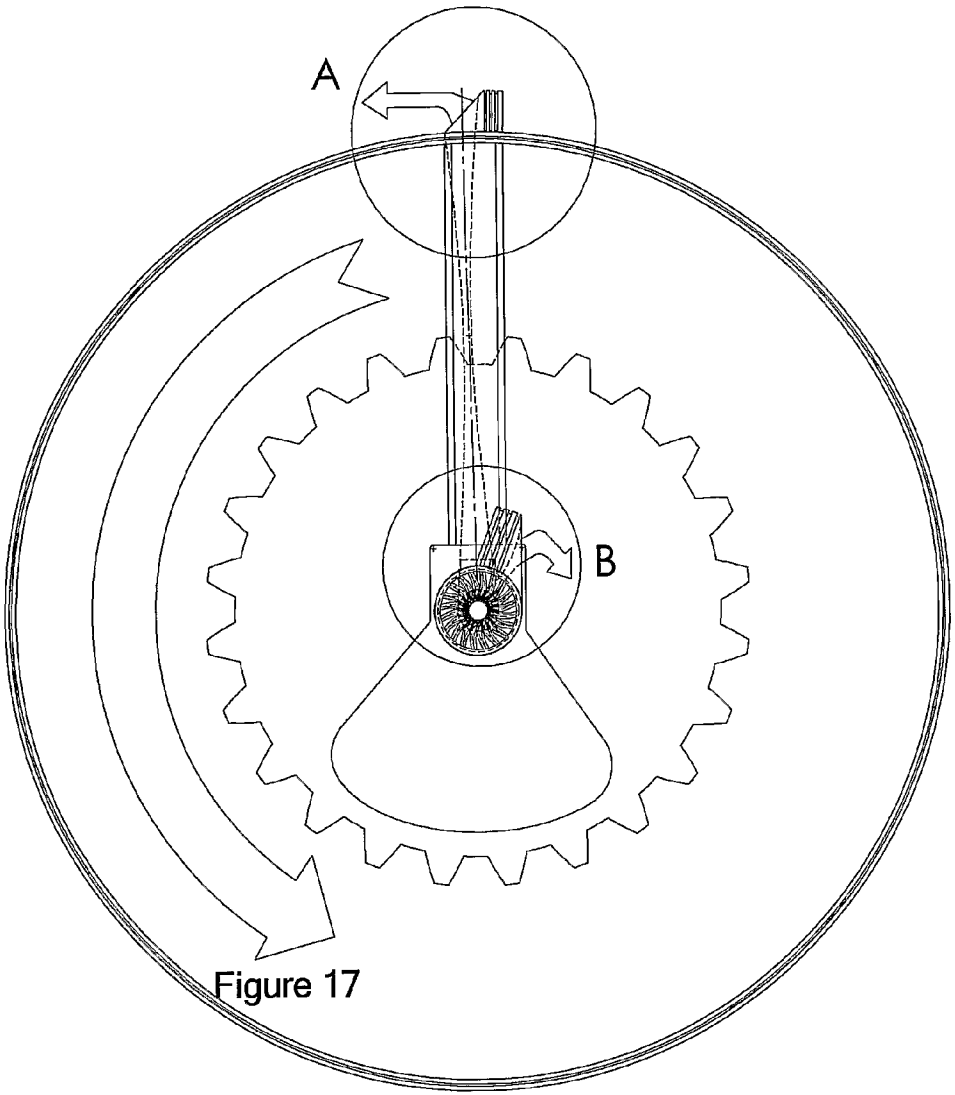
Figure 17

INTERNAL COMBUSTION ENGINE

CROSS-REFERENCE TO RELATED APPLICATIONS

This application is an U.S. national phase application under 35 U.S.C. §371 based upon co-pending International Application No. PCT/GR2006/000027 filed on Jun. 2, 2006. Additionally, this U.S. national phase application claims the benefit of priority of co-pending International Application No. PCT/GR2006/000027 filed on Jun. 2, 2006 and Greece Application No. 20050100405 filed on Aug. 1, 2005. The entire disclosures of the prior applications are incorporated herein by reference. The international application was published on Feb. 8, 2007 under Publication No. WO 2007/015114.

BACKGROUND OF THE INVENTION

Field of the Invention

The current invention request describes the function of a rotary motor which may replace the existent internal combustion engines in most of their today applications.

SUMMARY OF THE INVENTION

This engine has the following special structural characteristics:

what is important to an engine is the output torque of its engine-shaft, (crankshaft in the case of a reciprocative motor). In order to maximize this torque, it is necessary to maximize the torque that is produced on the engine-shaft because of the exhaust gas' expansion as well as to minimize the resistant torque produced by the air or air-fuel mixture compression. Generally, the torque is defined as the product of the applied force vector times the vector from the axis of rotation to the point on which the force is acting. Thus, it is easy to imagine an axis ($\alpha$) on which two arms are located, with lengths $L_1$ and $L_2$ for the compression and expansion process, respectively (FIG. 1). If the forces of compression and expansion, $F_1$ and $F_2$, are applied respectively on the edge of the two arms, $L_1$ and $L_2$, in order to minimize the torque that produced on the compression-arm $L_1$, it is necessary to minimize or even zero the length of the compression-arm. On the contrary, in order to maximize the expansion-torque produced by the force $F_2$ on the expansion-arm, it is necessary to have an expansion-arm $L_2$ as long as possible. In the case of compression, this can be easily succeeded by locating the compression-chamber and its piston (compression piston) on the cylindrical surface of the engine-shaft. In this way, the length of the compression-arm is equal to zero and the distance between the compression force and the gudgeon of the engine-shaft (a) minimal. In the case of expansion, the expansion-arm $L_2$ must be as long as the available space of the engine allows. Applying a force (the expansion force) on the free edge of this arm, the longer the arm, the greater the torque that will be applied on the shaft (a). That means, the compression-piston is recommended to be located directly on the engine-shaft while the expansion-piston on an arm attached to the shaft maximizing the piston's distance from the shaft. All pistons are moving in circular orbits whose planes are vertical to the gudgeon of the engine-shaft and have a cylindrical shape, with the axis of their cylinder to be coincident with the ring tour of their motion (that means the cylinder axis is not a straight line, but makes a curve). The sealing of the pistons is easy, using the rings that have been developed for the reciprocative motors' pistons. The combustion-chamber is formed by a ring shaped fixed shell, which surrounds the cylindrical surface of the expansion-piston, and a moving wall that is necessary to retain the sealing of the chamber in the whole duration of the synchronous motion of the expansion-piston with its arm.

The current motor has one piston for the intake and the compression of the air and one piston for the combustion of the fuel-air mixture and the expansion of the exhaust gases. The pistons are moving on a circle round the gudgeon of the engine-shaft. The combustion and expansion process actuates the expansion-piston on a circular motion. The expansion-piston actuates in rotation the motion-arm and the latter the engine-shaft. Finally, the engine-shaft's rotation actuates the compression-piston. At the same time of the expansion process of an operating cycle, the compression process of the next operating cycle is in progress.

The current motor needs three chambers for the completion of its operating cycle (FIG. 2). One chamber for the intake and compression of the combustion air or fuel-air mixture (compression chambers 2$\alpha$ and 2$\beta$), one chamber for the storage of air or fuel-air mixture under high pressure (pressure chambers 3$\alpha$ and 3$\beta$) and a chamber for the combustion of the fuel-air mixture and expansion of the exhaust gases (combustion chamber 1). The pressure chamber contains air or fuel-air mixture whose pressure has the same value with the pressure that is able to guide the fuel-air mixture in the combustion chamber to ignition. In the case of storing fuel-air mixture in the pressure chamber, the mixture must be stored under pressure lower enough of the auto-ignition pressure of the mixture making the presence of spark plugs necessary inside the combustion chambers in order to start the ignition (8$\alpha$ and 8$\beta$). The spark-plugs increase the temperature of the mixture to the ignition temperature (that means they create the appropriate conditions to start the combustion) (FIG. 3). Since the combustion chamber is far enough from the compression chamber, a single connection canal between these two chambers would provide the expansion of the compressed air or air-fuel mixture inside the canal, during its transfer from the one chamber to the other, so that the final pressure of the air or air-fuel mixture, as they entered the combustion chamber, would be less than the desired and the combustion and expansion process would be significantly weaker. In the case of using a single transfer canal and compressing the air or air-fuel mixture in a pressure much higher than the desired in order for the fluid to reach the combustion chamber with a pressure close to the desired, in spite of its expansion inside the canal, the canal's volume is so big, in comparison to the volume of the compressed air or air-fuel mixture, that the compression rate must be too high and a significant part of the effective torque would be lost with no reason. Moreover, there must be an extra reinforcement for the materials in order to withstand the higher pressure. In order to avoid these problems, the current rotary motor has a third chamber between the compression and combustion chamber, the pressure chamber. Because of the long distance between the compression and combustion chamber, the pressure chamber is located between these two chambers in order to ensure that the pressure of the air or air-fuel mixture at the end of the compression process in the compression chamber will be the same with the pressure of the air or air-fuel mixture during its entering into the combustion chamber, without spending part of the effective power or demanding extra reinforcement of the engine's materials. The compression and combustion chamber are connected only with the pressure chamber, while their direct intercommunication is not possible because of their distance. The communication between the compression and pressure chamber is possible through a valve that can be either an one-way solenoid valve—from the compression chamber to the pressure chamber—(11α FIG. 4) which allows the transit of the air or air-fuel mixture only when the pressure in the compression chamber is equal to or greater than the pressure in the pressure chamber. Once the sliding port of the compression chamber opens (6α and 66β—FIGS. 2 and 4), the pressure in the compression chamber reduces because the compressed air is mixed with the atmospheric air from the induction chamber and the one-way valve (11α) seals. For the communication of the pressure chamber with the combustion chamber a one-way solenoid valve is also used (from the pressure chamber to the combustion chamber) (9α FIG. 3), electronically controlled. Finally, every pressure chamber has a relief-valve (5α FIG. 2) in order to avoid the extreme increase of pressure inside the pressure chamber because of the high temperature that could developed through the motor operation or hot climate.

BRIEF DESCRIPTION OF THE DRAWINGS

The invention will now be described by way of example and with reference to the accompanying drawings in which the recommended details are not obligating for the construction of the engine. The dimensions are indicative and the figures are aiming to the better understanding of the aforementioned description. Using the up-to-date know-how of the existing motors may improve the designation of this motor even more. All the details that are not depicted on the following figures are omitted on purpose because they can be parts of the existent motors, such as the fuel-feed and fuel-injection system:

FIG. 2: The fixed part of the motor with the sliding ports of the compression- and combustion-chambers.

FIG. 3: Detail A of FIG. 2 for the better observation of the parts of the pressure- and combustion-chamber FIG. 4: Detail B of FIG. 2 for the better observation of the parts of the pressure- and compression-chamber

FIG. 17: FIG. 15 with the circulation arrows of the cooling air.

FIG. 18: Detail A of FIG. 17.

FIG. 19: Detail B of FIG. 17.

FIG. 15 with a couple of expansion-pistons.

DESCRIPTION OF THE PREFERRED EMBODIMENT

Figure 1:
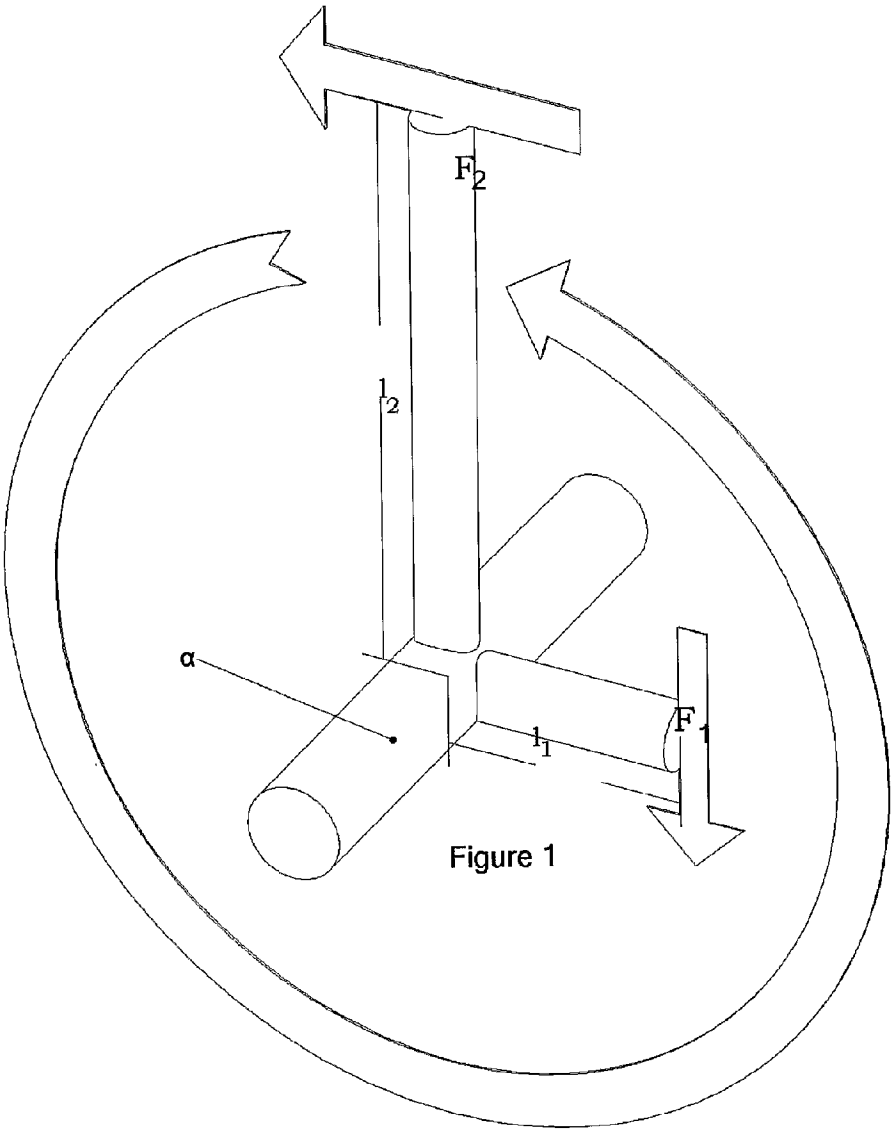
FIG. 1: An engine-shaft with two arms (a compression- and an expansion-arm)
Figure 6:
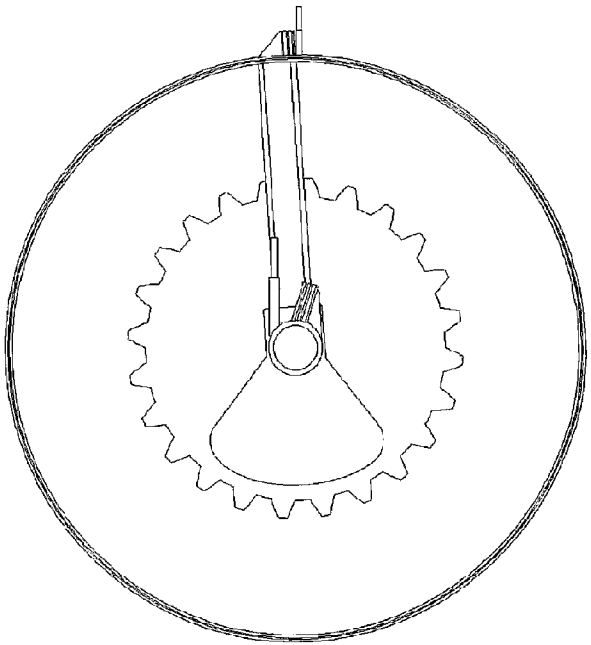
FIG. 6: Another point of view of the FIG. 5

The motor consists of four moving and one stable part which are depicted in the FIGS. 2 to 6:

The stationary external block of the engine (FIG. 2) comprising of the combustion-expansion chamber (1), the induction-compression chambers (2α and 2β), the pressure chambers (3α and 3β) and the air filters (4α, 4β, 4γ and 4δ). The air filters are located on the shells of the compression chambers in the inlet openings of the atmospheric air. In the figures, the air-filters are located on both sides of every compression chamber creating two inlets of atmospheric air in every chamber. The pressure chambers may have every possible shape. However, in the figures a canal-shape is chosen so that the chamber will have the minimum possible volume. On the shell (1) two fuel injectors (7α and 7β) and two spark-plugs (8α and 8β) are fitted. The numbers 6 and 12 represent the sliding ports of compression- and expansion-chamber, respectively. The place (10) is the point where the exhaust gases enter into the exhaust outlet in order to be removed.

The moving part (see FIGS. 5 and 6) comprising of the engine-shaft (16), the compression pistons (13α and 13β), the motion-arm (15) and the expansion piston (14). The choice of using two compression pistons and, correspondingly, two compression chambers as well as two pressure chambers is not necessary. A couple of them are used only to balance the engine-shaft. Only a single compression piston could be used and, correspondingly, a single pressure- and compression-chamber. Round the engine-shaft a cogwheel is located indicatively (17) through a wedge (18) for the transmission of the engine-shaft's motion to the gear box.

Figure 5:
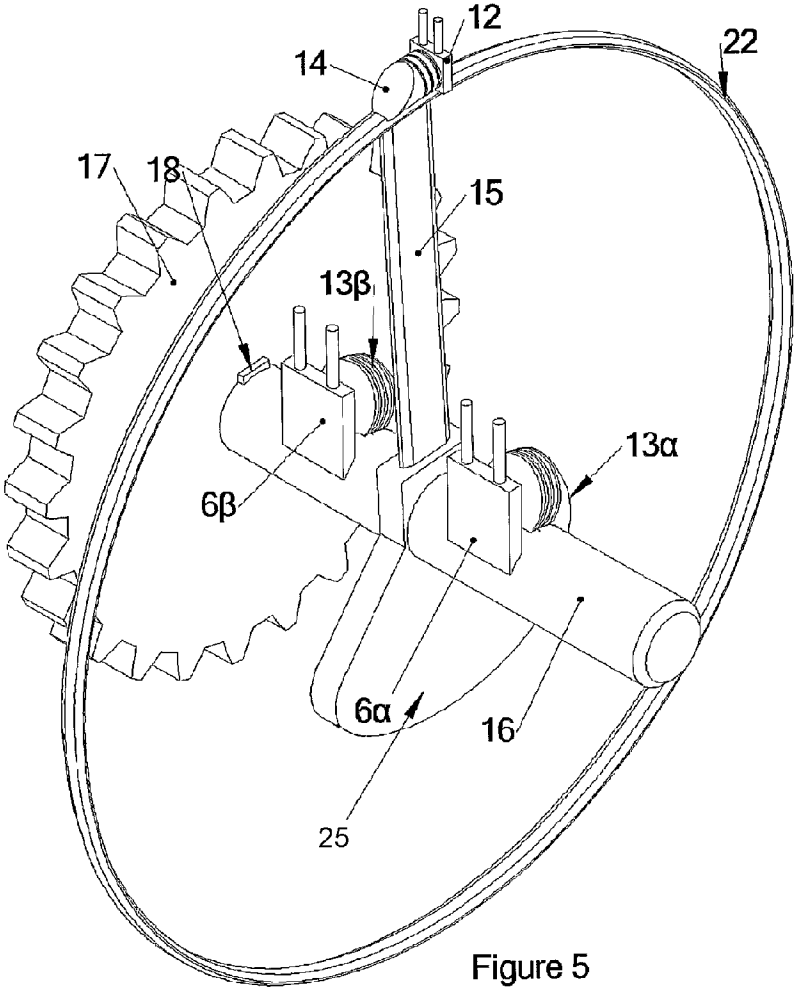
FIG. 5: The sliding ports and the moving part comprising of the engine-shaft, the motion-arm, the moving wall of the combustion chamber and the pistons

The sliding port (12) of the combustion chamber (1), (FIG. 5). The sliding port, when it is closed, is through a spring pressed on the surface of the moving wall of the combustion chamber in order to prevent the mixing of the fuel-air mixture with the exhaust gases of the previous operating cycle.

The sliding ports (6α and 6β) of the compression chambers (2α and 2β), (FIG. 5). These sliding ports, when they are closed, are pressed by a spring on the surface of the engine-shaft in order to prevent the communication of the compressed air or air-fuel mixture with the atmospheric air of the intake chamber.

The valves (5, 9 and 11) (FIGS. 2 to 4) of the pressure chambers (3α and 3β) for the communication of the pressure chamber with the other chambers and for the control of its pressure. The numbers (5α and 5β) represent the relief-valves for avoiding the exaggerated increase of the pressure inside the pressure chamber. The numbers (11α and 11β) represent the one-way valves for the communication of the compression chambers with the pressure chambers. The numbers (9α and 9β) represent the one-way valves for the communication of the pressure chambers with the combustion chamber. The valves (5, 9 and 11) can be controlled by an engine processor.

The figures depict only one side of the motor. Therefore, only one pressure chamber and one compression chamber are visible, but, obviously, everything that is mentioned about them concerns the operation of the other pressure and compression chambers, too. That means that the description is referred synchronously to the couple of pressure and compression chambers. Finally, there are flow arrows in the figures which show the position and direction of the working medium. For the current motor, the working medium doesn't remain the same through the operating cycle, but changes inside the pressure chamber. More precisely, the amount of air that is sucked and compressed in the compression chamber is stored in the pressure chamber and the same amount is fed from the pressure chamber into the combustion chamber.

Figure 7:
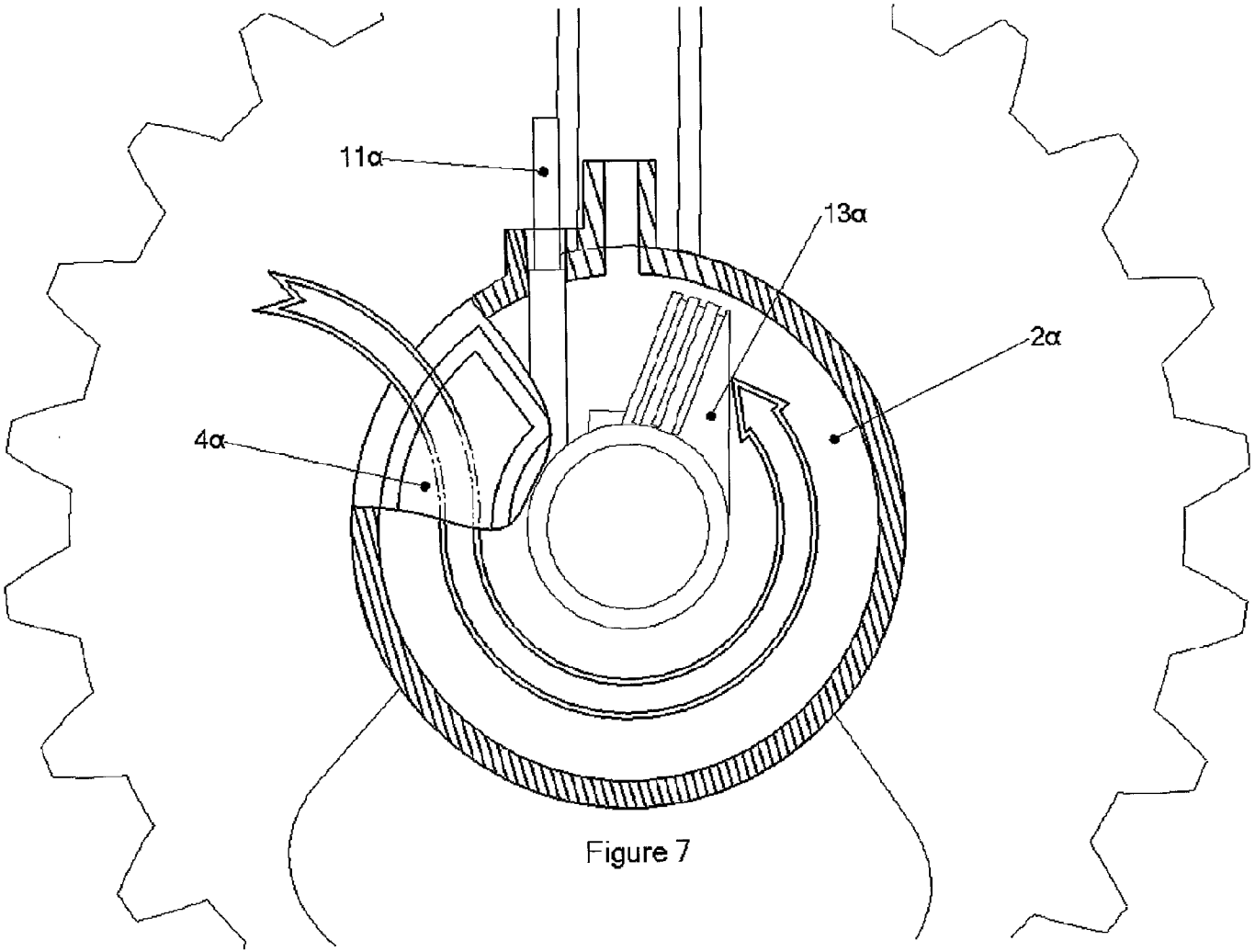
FIG. 7: The intake phase of the atmospheric air.

Function Principal: [FIG. 7]: the rotation of the compression piston (13α) creates an area of very low pressure behind it which forces atmospheric air to enter into the compression chamber (2α) through the air filters (4α and 4β).

Figure 8:
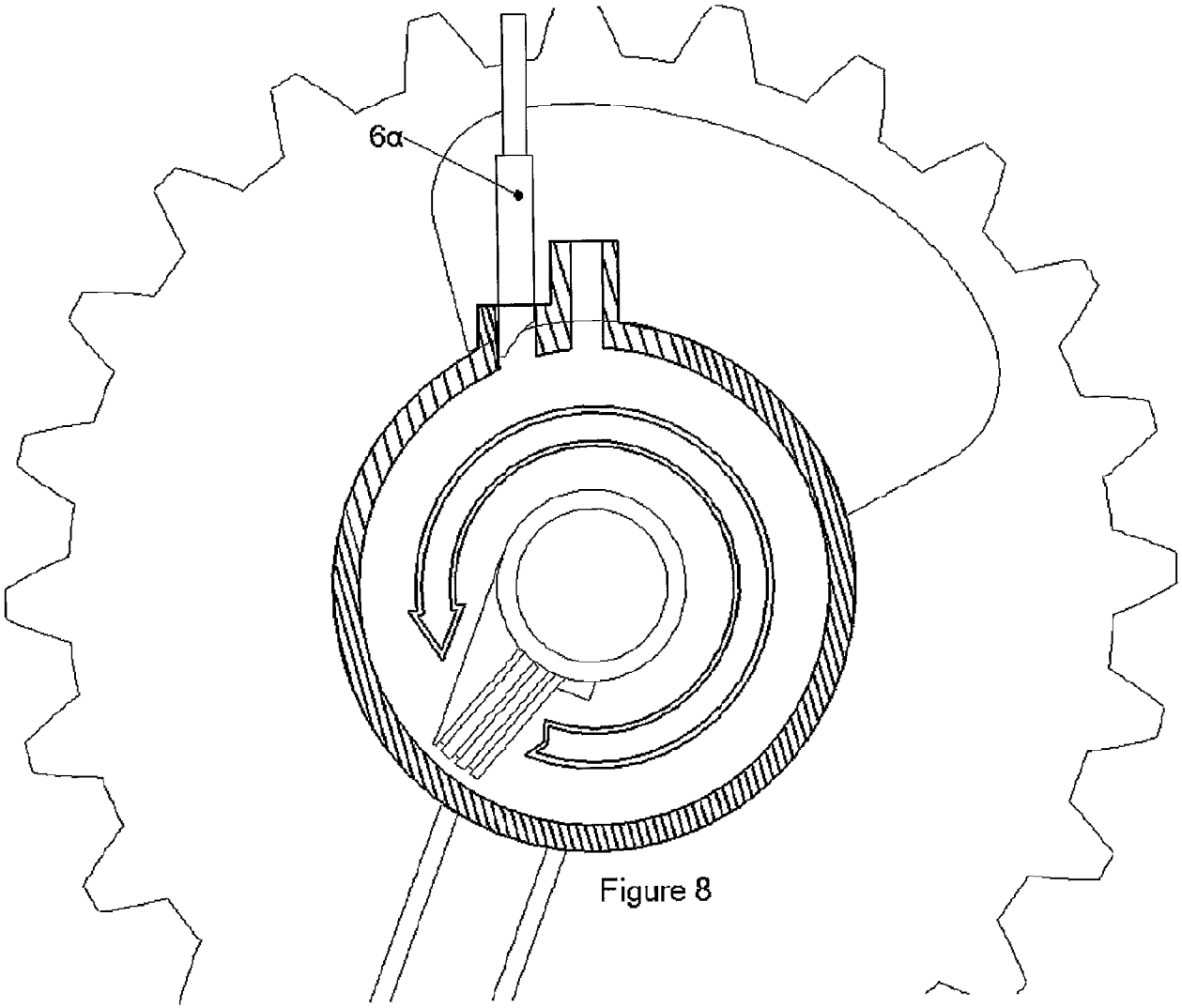
FIG. 8: The phase of free motion of the compression-pistons inside the compression-chambers.

[FIG. 8]: the sliding ports (6α and 6β) are wide open permitting the rotation of the compression pistons inside the compression chambers without any essential resistance. Once the whole volume of the compression chamber is covered with atmospheric air, the combustion air circulates unblocked inside the compression chamber.

Figure 9:
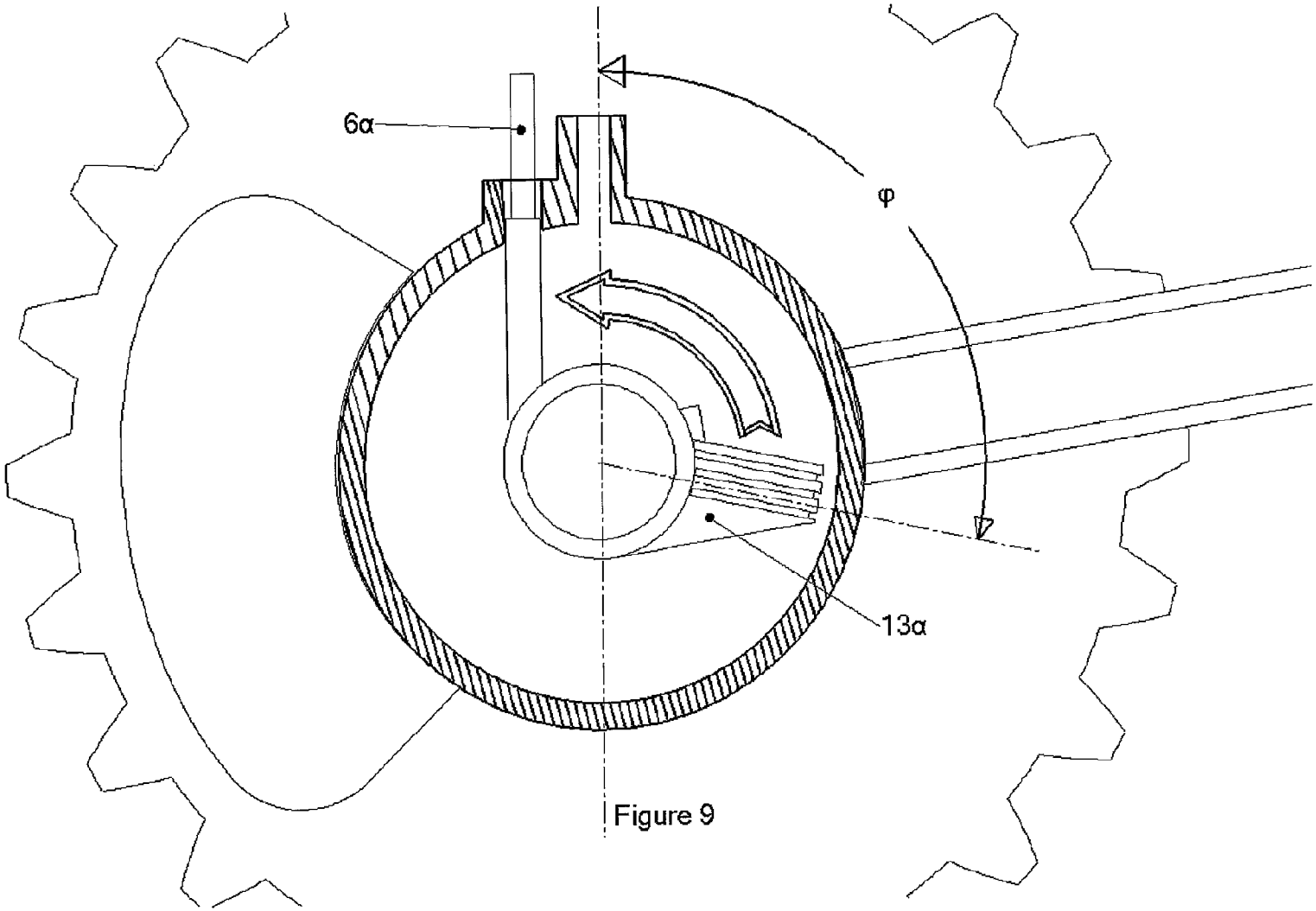
FIG. 9: The time when the compression process starts.

[FIG. 9]: the pistons (13α) and (13β) are coming to the desired position in order to begin the compression process (angle ϕ). The angle ϕ is the angle that specifies the compression's volume and, subsequently, the amount of air that will be compressed in every operating cycle. Thus, changing the value of the angle, changes the cubic capacity of the motor, too. The cubic capacity in this engine is the volume of air that is compressed. The value of the angle ϕ is essentially determined by the timing of the sliding ports. The timing of these ports regulates the volume of the combustion air that will be compressed. Such a regulation is very important for the fuel consumption as far as vehicles is concerned. If it is possible to electronically regulate the timing of the sliding ports, the duration of the operating cycle may be regulated according to the traffic conditions. That means that the driver of a vehicle with an engine of big cubic capacity will be able to adjust the timing of the sliding ports in order to reduce the amount of air and fuel that are led to the chambers when the traffic conditions do not permit the utilization of the maximum vehicles' acceleration. Once the piston reaches the position with angle ϕ calculated from the position of the sliding ports, the ports (6α) and (6β) close, trapping a significant part of the air that circulates inside the compression chambers. This volume is formed by the pistons (13α) and (13β) and the sliding ports (6α) and (6β), respectively. This space is the real compression's volume, while the rest part of the chamber is only for the intake of atmospheric air (induction chamber). The air that remains in the induction chamber is mixed with the new intake atmospheric air that enters the chamber through the air filters because of the low pressure that is created on the back side of the compression pistons as longs as the sliding ports (6α) and (6β) remain close.

Figure 10:
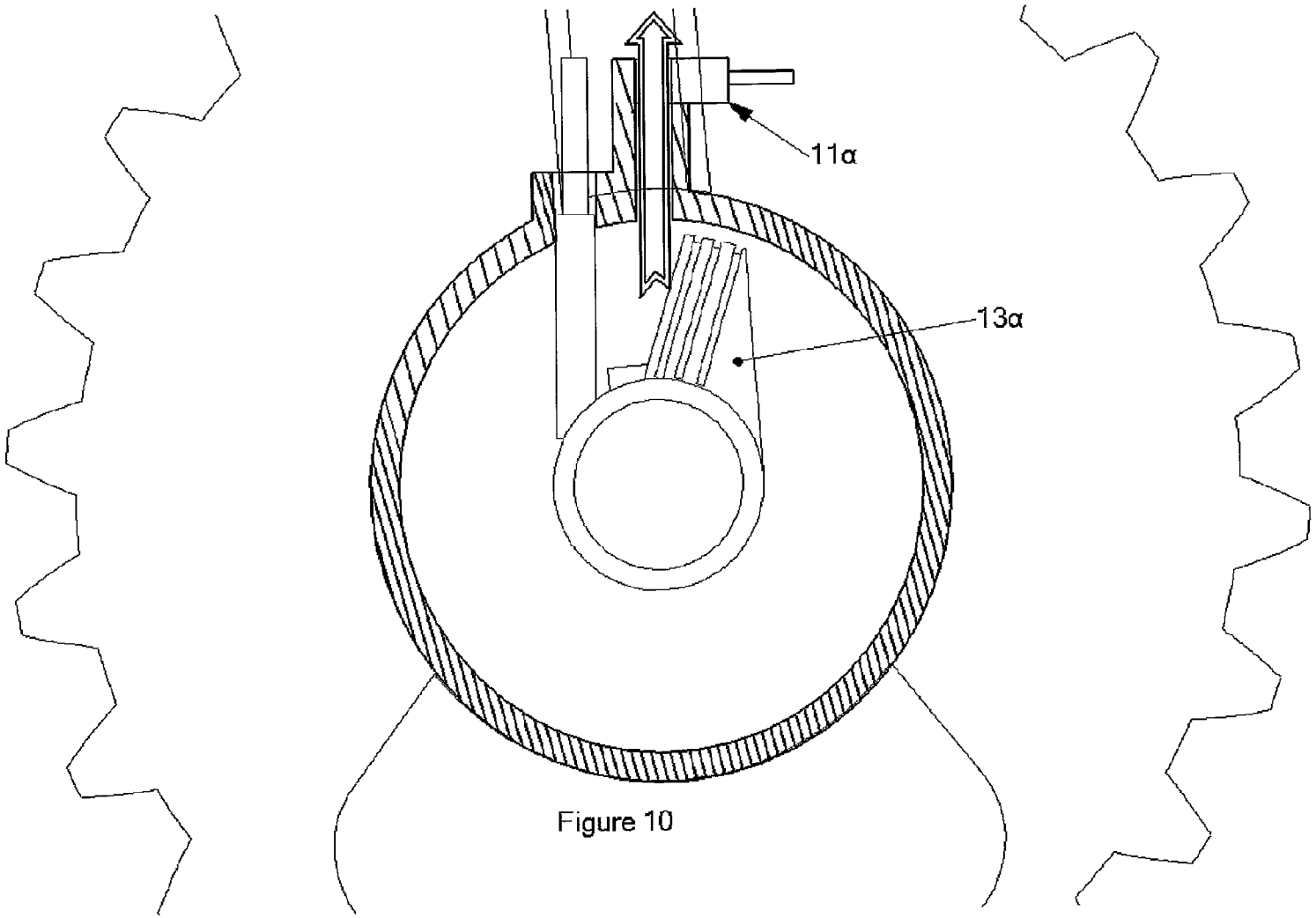
FIG. 10: The final stage of the compression process.

[FIG. 10]: while the rotation of the compression pistons (13α and 13β) continues, the pressure of the trapped air (combustion air) increases continuously. Once the compression phase is complete, the pressure is high enough to make the valves (11α and 11β) open and allow the compressed air to enter from the compression chamber to the pressure chamber.

Figure 11:
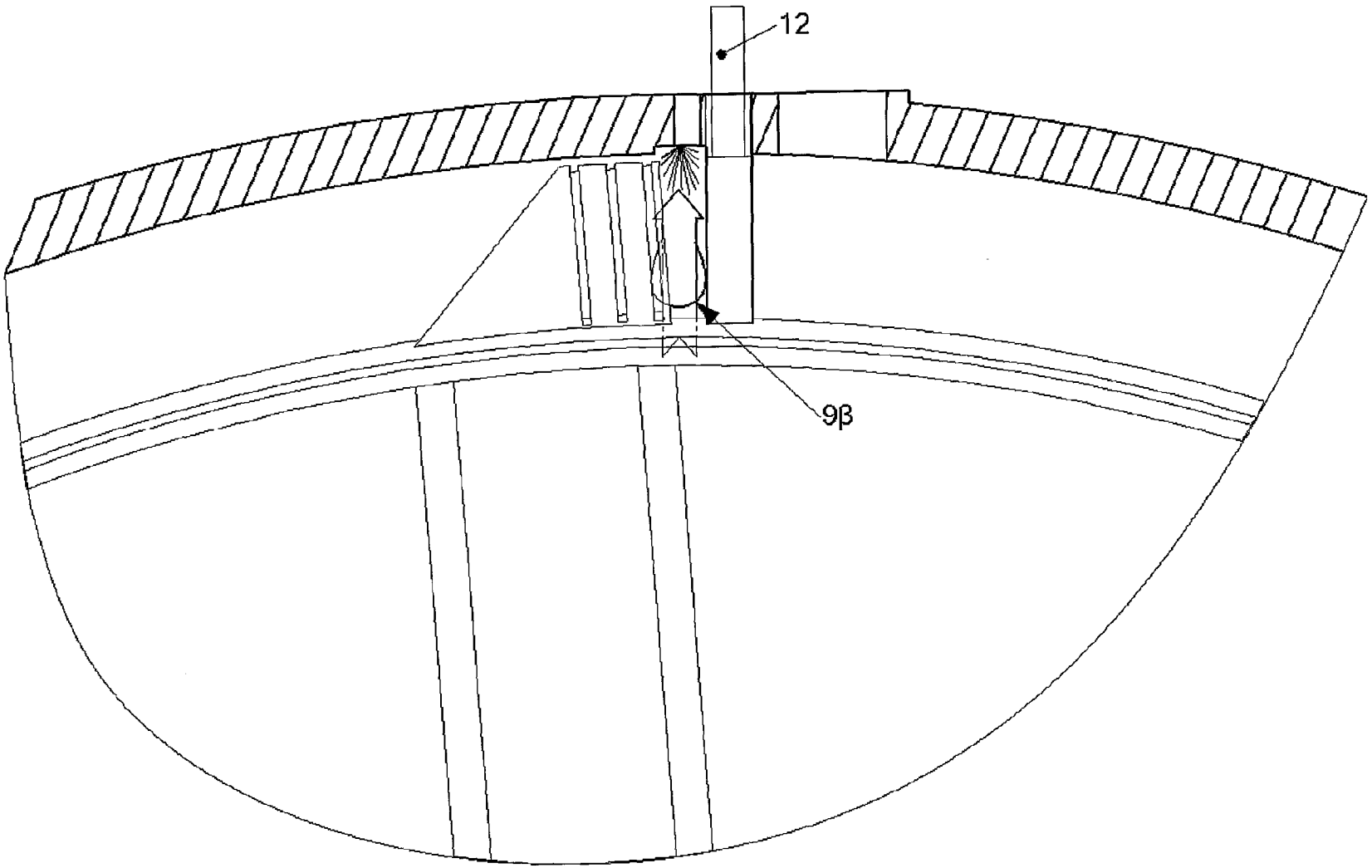
FIG. 11: The entrance of the air or fuel-air mixture into the combustion-chamber from the pressure-chamber (final stage of the compression process)

[FIG. 11]: Simultaneously, the valves (9α and 9β) open in order to allow the same amount of compressed air to leave the pressure chamber and to enter the combustion chamber so that the total pressure inside the pressure chamber remains the same as before the opening of the valves. Once the transfer of the compressed air from the pressure chamber to the combustion chamber is complete, the sliding ports (6α) and (6β) of the two compression chambers open so that the compression pistons can pass under them. On the other hand, the opening of these sliding ports equates the pressure of the compression chamber with the atmospheric pressure causing the direct closing of the valves 11 because of the pressure difference that prevails between the two sides of these valves. The valves 11 remain closed because of the pressure difference until the pressure in the compression chamber becomes again equal to or greater than the pressure inside the pressure chamber. The sliding ports remain open until the compression pistons come again in the right angle to start the compression phase of the next operating cycle (angle ϕ). While the valves 9 open and the compressed air enters from the pressure chambers to the combustion chambers, the fuel is injected in the combustion chamber. Because of the pressure difference between the pressure chamber and combustion chamber, the compressed air enters the combustion chamber with a high velocity and turbulence. Its entrance is favored from the low pressure that is created on the back side of the combustion piston. Thus, the fast mixture of the air with the fuel is ensured as well as the fast gasification of the fuel.

Figure 12:
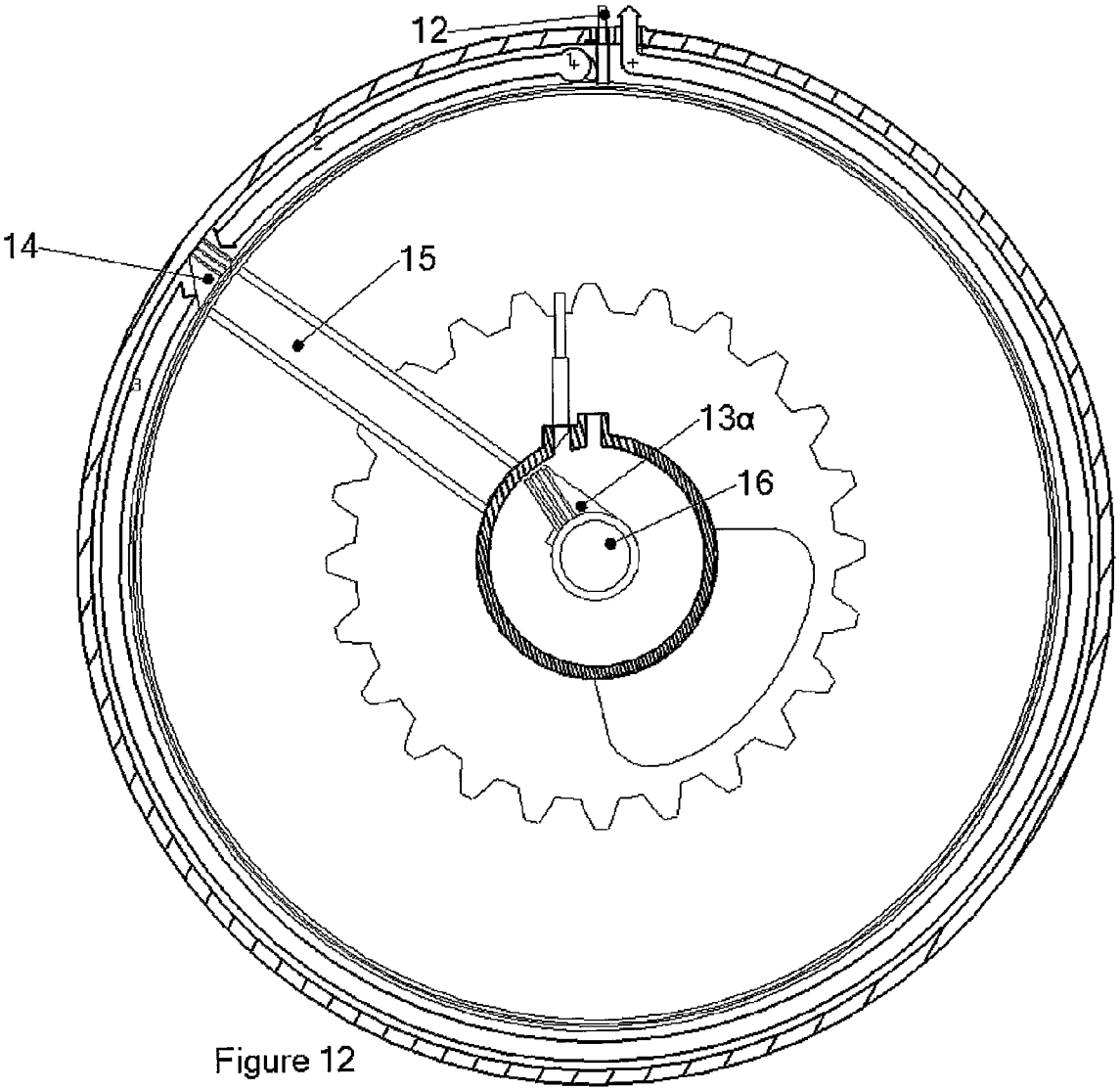
FIG. 12: Phase of combustion, expansion and how the exhaust gases are removed.

[FIG. 12—position 1 of the flow arrow]: The high pressure causes the mixture's auto-ignition, while a couple of sparkplugs (8α and 8β) (see FIG. 3) enforces the fast flame transmission through the whole volume of the combustion chamber, in order to, at least theoretically, utilize the advantages of the combustion under constant volume.

[FIG. 12—position 2 of the flow arrow]: the produced exhaust gases expand pushing the expansion piston (14) into a circular motion. The expansion piston (14) rotates the arm (15) and the arm rotates the engine-shaft (16), which, finally, rotates the compression pistons (13α and 13β). The expansion continues until the expansion piston reaches the closed sliding port (12).

In that moment, the sliding port (12) opens and while the expansion piston (14) passes over the valves 9α and 9β (see FIG. 11), the entering of the compressed air of the next operating cycle into the combustion chamber from the pressure chambers starts, preventing the entering of the exhaust gases into the combustion chamber, since the high pressure that prevails in the combustion chamber forces the exhaust gasses to move out through the outlet canal 10 (see FIG. 3)

[FIG. 12—position 3 of the flow arrow]: as the piston (14) passes the sliding port (12), the latter closes and the piston pushes the exhaust gases to move out through the outlet canal. This is the operation principal of the current motor and after that the whole procedure starts all over again.

The motor, as described above, has the following advantages:

The most important point to focus on this engine is the effort to position the combustion chamber as far away from the engine-shaft as possible, while the compression chamber must be located as close as possible to the engine-shaft. This principal aims to maximize the torque produced by the engine-shaft and to minimize the torque that the compression pistons need (through the engine-shaft) in order to compress either the combustion air or the fuel-air mixture. This distance between the compression chamber and the combustion chamber promises that the motor will have a torque much more than the existent or under research motors with the same fuel consumption. This distance is making necessary the existence of a third chamber, the pressure chamber, which will ensure that the thermodynamic conditions at the beginning of the combustion process are the same with the conditions at the end of the compression process, without requiring too high compression ratios and materials which can resist these ratios.

The fact that the timing of the compression sliding ports is not standard and can change, changing the amount of the combustion air, makes possible the regulation of the size of the compression volume according to the desires or requirements of the engine's user. In the case that the motor will operate as an atmospheric engine, the compression volume determines the mass of the combustion air and subsequently the fuel consumption through the air ratio λ. So, in the case of a car engine, the driver may regulate through an electronic system the timing of the sliding ports and consequently the fuel consumption according to his needs, if he is stuck in a traffic-jam or he is running on the high-way. In the first case, the vehicles with a big cubic capacity may reduce their compression ratio to a value that is quite enough only to move the vehicle and not to achieve great accelerations. This will reduce significantly the fuel consumption as well as the environmental pollution of the vehicles, especially in the case of high traffic.

In the case of vehicles, the ability of constructing a car-engine that may operate with a variety of compressed air according to the timing of the sliding ports allows the construction of one single engine for using it to a variety of versions of the same car (for instance sport version, station-wagon, SUV etc).

Figure 13:
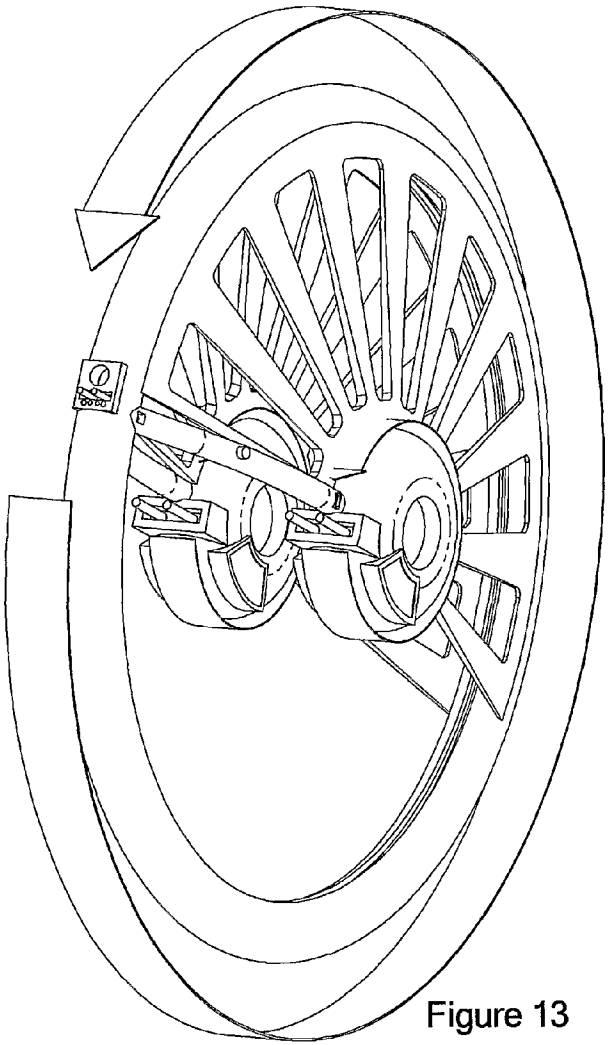
FIG. 13: the circulation of water cooling

The construction cost of the current engine may be lower than the existent. On the other hand, its simple design makes easier the planning of the water-cooling system and lowers the energy that demands the cooling water for its circulation. In the case of a water cooling system, the simple design of the system makes easier the water circulation in all high temperature places of the engine without sudden direction changes and complicated routes. This reduces the pressure drop of the flow and the energy that the water plump demands. This can be easily shown in the FIG. 13 which depicts a water-cooled engine and the circulation of the cooling water. The cooling water covers all the external surface of the combustion-expansion and compression chamber. As far as the pressure chamber is concerned, since the gas in this chamber has a constant temperature during the whole operating cycle, it may be constructed using a material that affords this temperature and avoid the cooling of this chamber. Moreover, if the engine constructor desires to retain the high temperature of the stored medium, it is recommended not only to avoid the cooling of this chamber but also to use a temperature insulating material.

Because of the simple construction of the engine, the mechanical losses are less, while the fact that the pistons do not move reciprocatively, allows the achievement of a great number of rotations with low noise.

The exhaust gases, while they are pushed by the expansion piston direct to the outlet canal, they reach the canal with a very high kinetic energy and a continuous flow. Thus, they can be utilized for covering either the electrical requirements of the motor (such as the sliding ports' operations or the oil plump or water plump operation) or the mechanical requirements such as the operation of the fan in the case of an air cooling system.

The operating principle of the current engine may eliminate problems such as prior-ignition of the fuel. The motion of the combustion-expansion piston is one way and not reciprocative. Thus, the prior ignition doesn't resist to the rotation of the piston. On the other hand, the phenomenon of prior-ignition is less possible in this motor because it is present in the reciprocative motors only close to the upper dead point where the velocity of the piston is close to zero. Consequently, in the current motor, where the piston has low velocities only when the engine starts, it is considered that such problems will not be present.

Finally, the entering of the compressed air from the pressure chamber into the combustion chamber is favored by the pressure difference between the pressure chamber and the combustion chamber. In that moment, in the combustion chamber there is a very low pressure because of the motion of the expansion piston (the expansion's sliding port is closed). Thus, a high turbulent flow is developed which is efficient enough to create a homogenous mixture before the beginning of the combustion phase.

Figure 14:
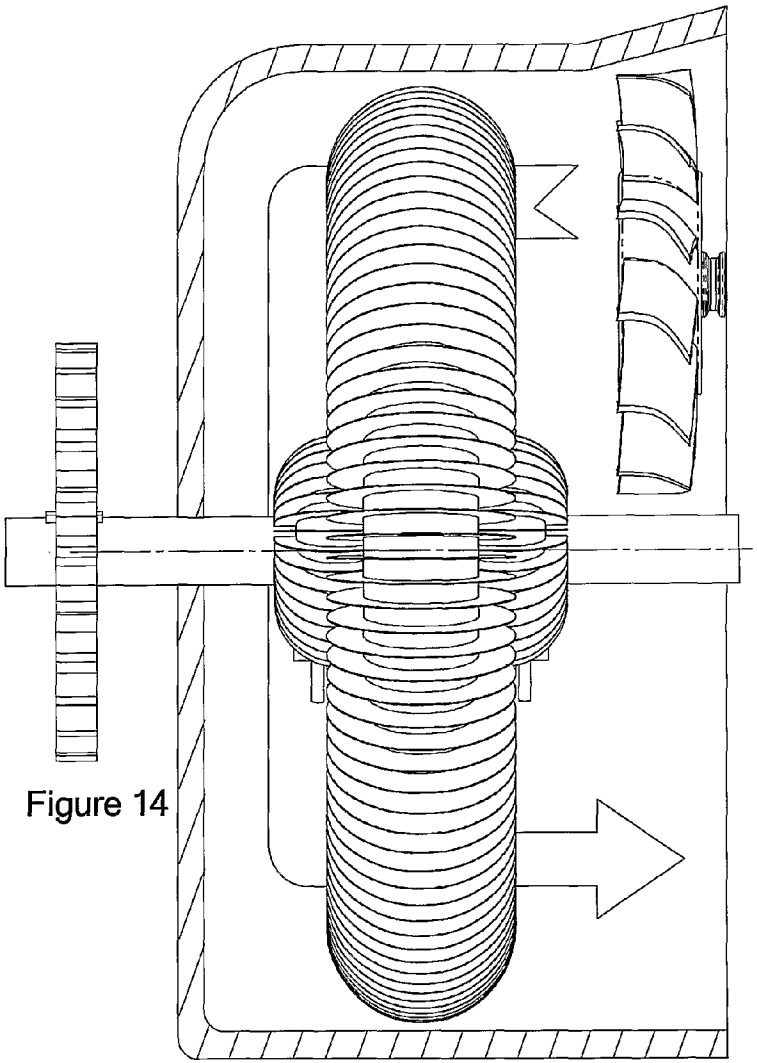
FIG. 14: the external air-cooling system of the engine
Figure 16:
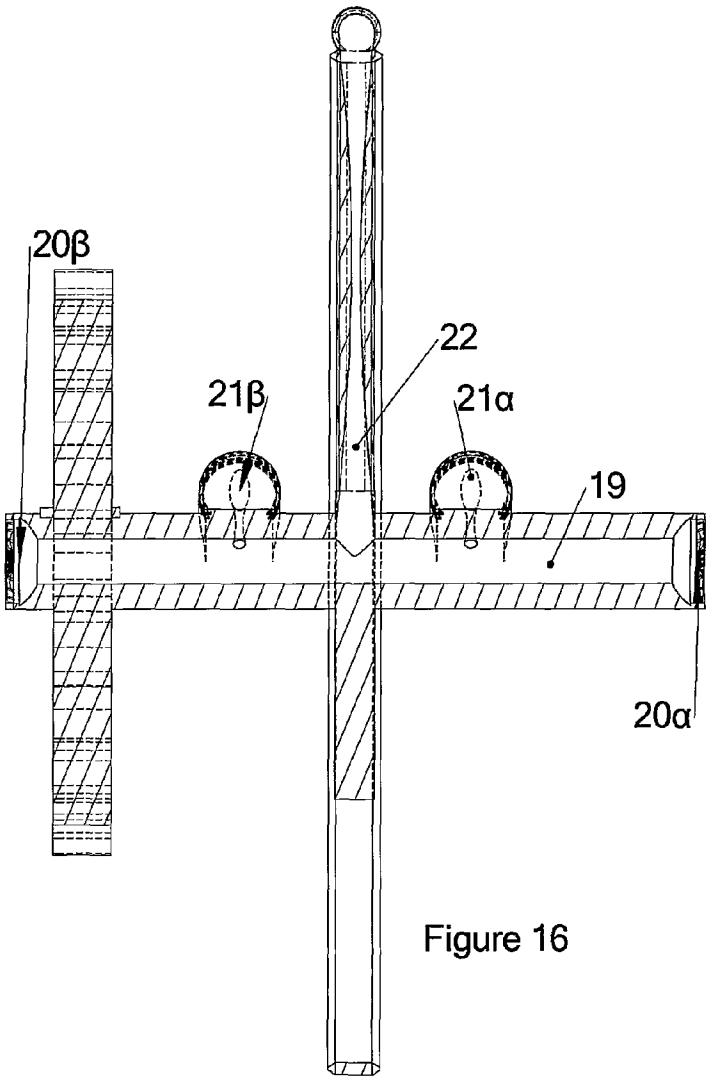
FIG. 16: Cross-section of the moving part that is illustrated in FIG. 15
Figure 15:
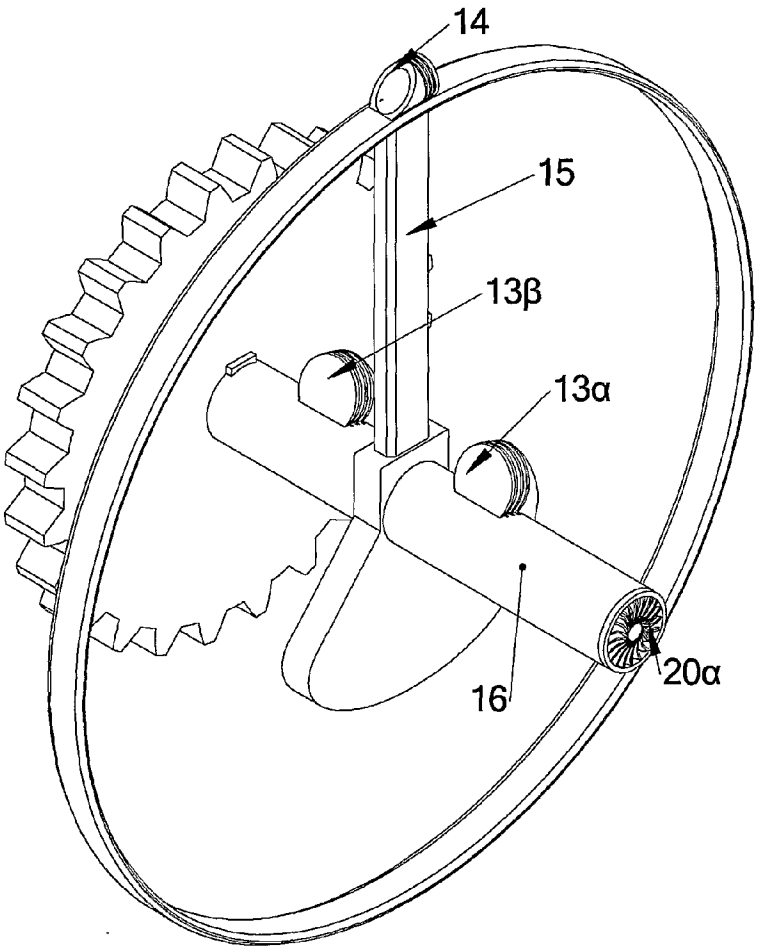
FIG. 15: The moving part comprising of the engine-shaft, the motion-arm, the moving wall of the combustion chamber and the pistons in case of the internal air-cooling

As far as the air cooling system is concerned, instead of using external cooling, through a fan and cooling wings (FIG. 14), it may be an internal cooling of the chambers (FIGS. 15 and 16). More precisely, since the pistons develop great laminar velocities during their rotation, it is interesting to utilize the developed centrifugal forces in order to cool the chambers. With an appropriate formation of the engine-shaft (16), the arm (15) as well as the pistons (13α, 13β and 14) (formation of their interior like a Venturi nozzle) (FIGS. 15 and 16), atmospheric air will be sucked, after it is cleared, it will be accelerated and guided against the interior walls of the chambers for their cooling.

This way of cooling does not need the air filters (4α) to (4δ). The air is filtered in various ways—even in the way the air is filtered in vehicles today—and then is guided on the edge of the engine-shaft, where the air is sucked through the embodied wings (20α) and (20β), located on the body of the engine-shaft, into the internal modulated canal (19) of the FIG. 16 and, after that, through the canals (21α), (21β) and (22) which have been modulated in the interior of the arm (15) as well as in the interior of the pistons (13α), (13β) and (14). Finally, the air hits against the internal walls of the chambers (2α), (2β) and (1) in order to cool them. The canals (21α), (21β) and (22) have in their interior the shape of a Venturi nozzle (FIGS. 15 and 16) contributing to the acceleration of the cooling air before the latter hits against the walls of the chambers. The cooling of the combustion chamber comes before the combustion, while the cooling of the compression chamber follows the compression process (FIGS. 17 to 19).

Figure 20:
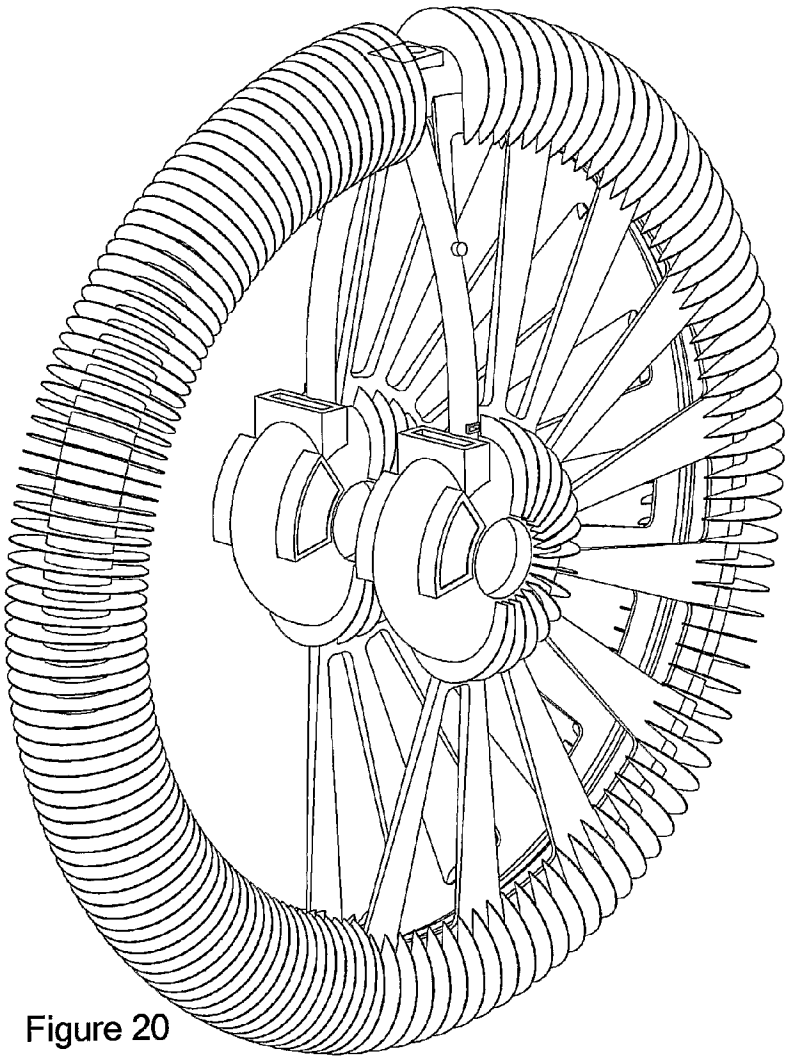
FIG. 20: The fixed block of the motor in case of the external air-cooling.

Moreover, the cooling of the whole motor can be supported by an external cooling like the FIG. 14 depicts, where the combustion chamber has external wings for its faster cooling. FIG. 20 better depicts the cooling wings like they are distributed on the three chambers.

Figure 21:
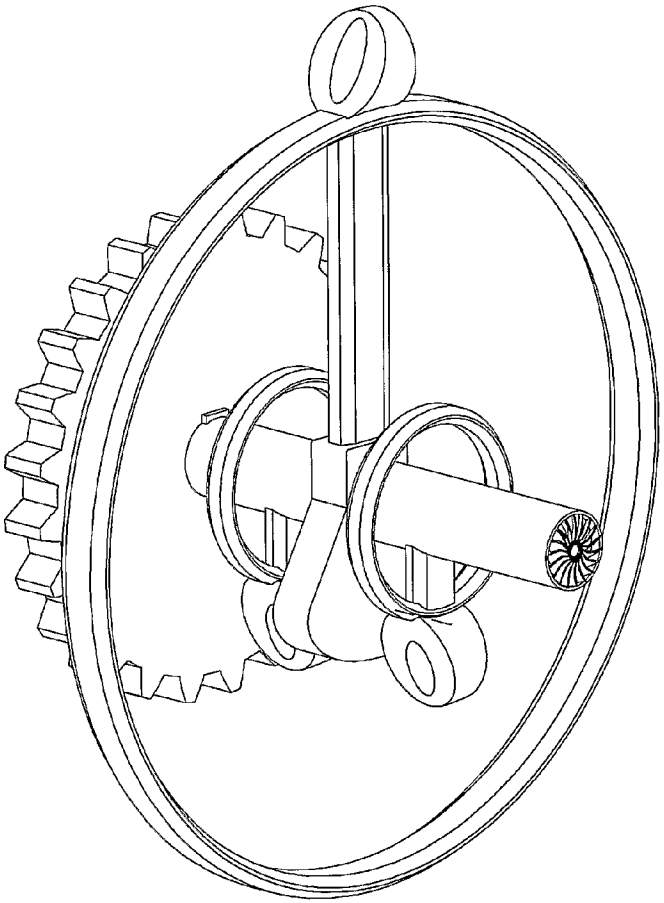
FIG. 21: The compression-pistons located on the arms which transfer the motion of the engine-shaft to the compression-pistons.

In the case of a motor with a big cubic capacity, the compression pistons may be placed far from the engine-shaft, located on an arm which will transmit the motion of the engine-shaft to the pistons, like the FIG. 21 depicts (the depicted engine-shaft is coming from an air-cooling motor). This is suggested because the volume of the compression chamber is calculated by the relationship $2nR \cdot nd^2$, where R is the rotation radius of the compression piston's center and d is the diameter of the chamber. Consequently, retaining the size of the compression piston constant (that means the diameter d), the volume of the chamber may be increased only by increasing the radius R. That means, the volume of the chamber increases by increasing the distance that the compression piston will cover.

Figure 22:
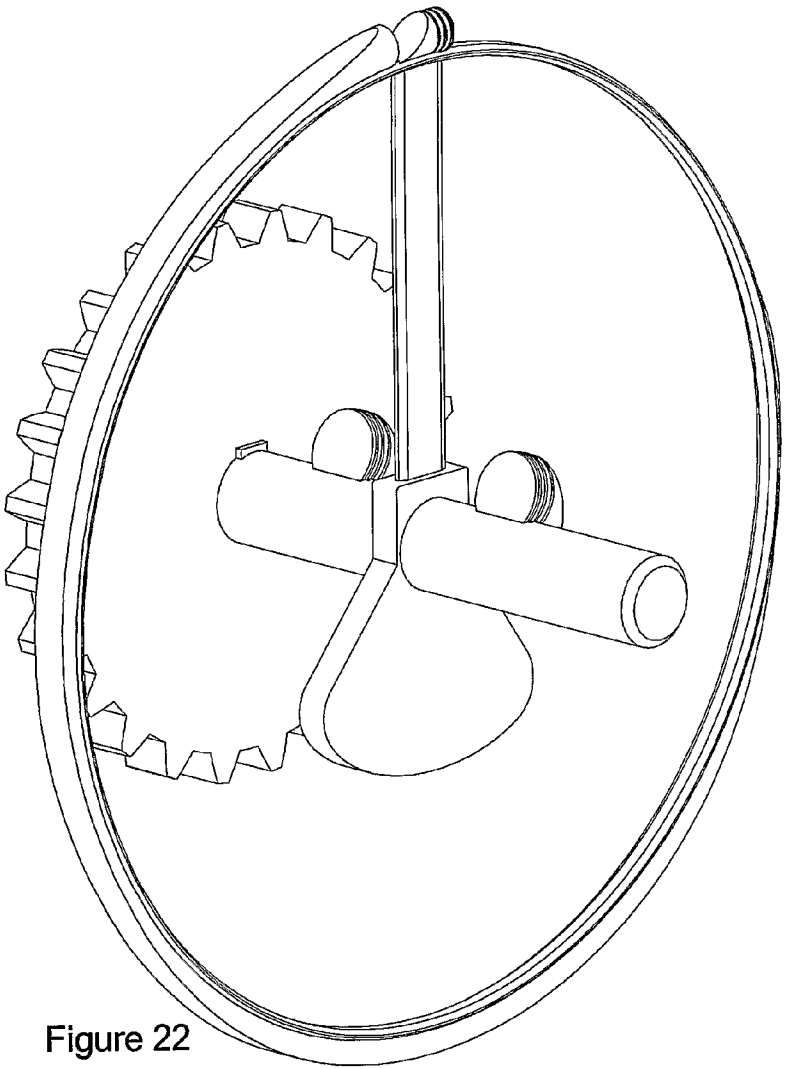
FIG. 22: The moving part of the engine where the rotating wall of the combustion chamber has a changing cross-section in order to retain the pressure in high levels during the expansion of the exhaust gases.

In order to retain the pressure inside the expansion chamber high for as long as possible, the moving wall of the combustion chamber (22) may be modulated so that the volume of the expansion chamber is growing in a very slow rate during the motion of the expansion piston. This is possible if the distance between the two internal walls of the chamber—the internal wall of the shell and the upper surface of the moving wall—is not constant but these two surfaces converge gradually (FIG. 22).

Figure 23:
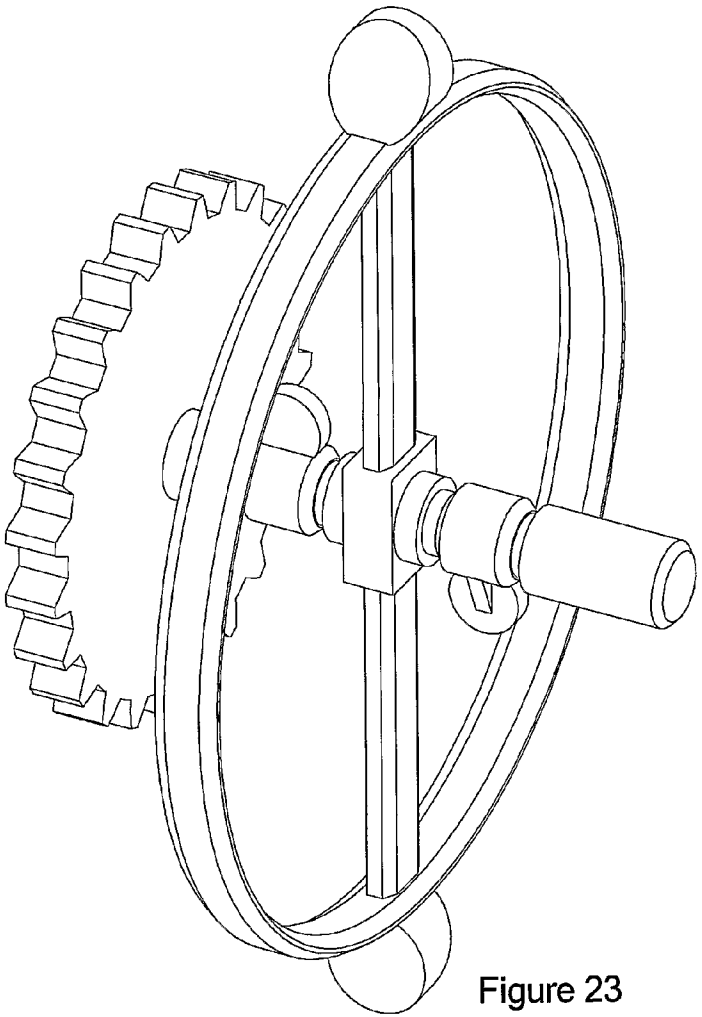
FIG. 23.

In FIG. 5, the number (25) is for the inertia mass that has been added in order to balance the expansion piston. This mass can be replaced from another arm and expansion piston like FIG. 23 depicts. In this case, the combustion chamber is divided into two combustion-expansion chambers (1α) and (1β). The gases expand in the half length and every pressure chamber is connected with only one compression chamber. The compression pistons are located in positions with 180° angle difference in order to minimize the required volume of the pressure chamber.

Figure 24:
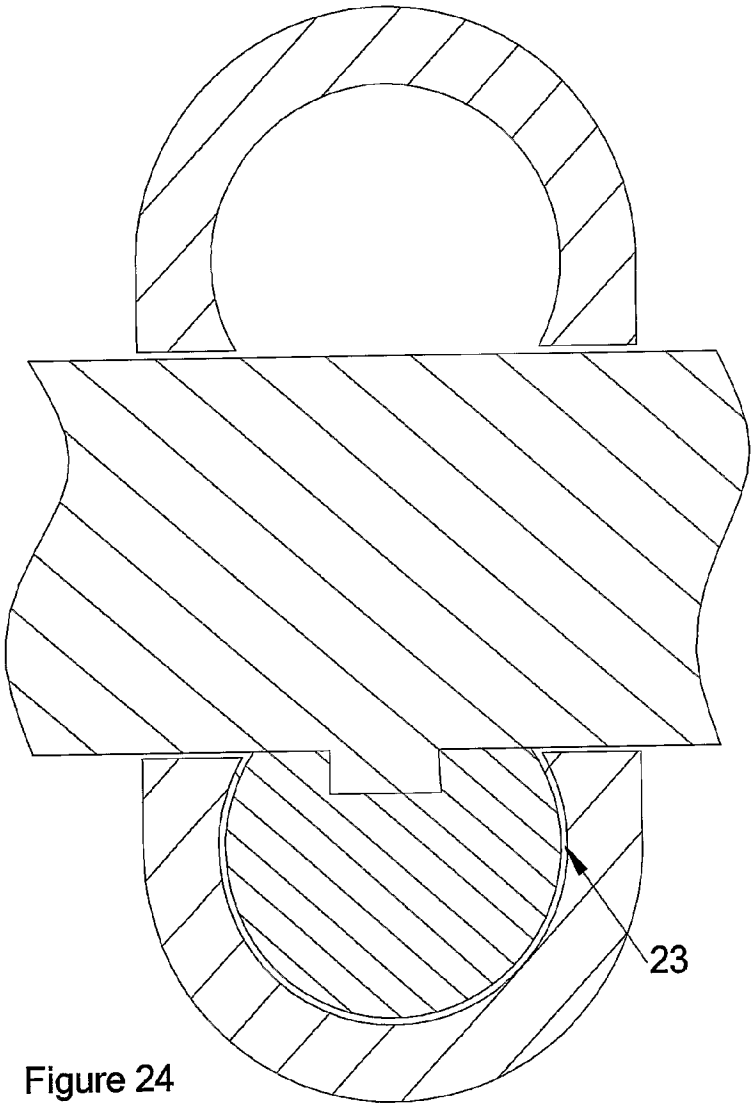
FIG. 24: the sealing of the compression-chamber and piston.

Finally, as far as the sealing is concerned, this can be succeeded as follows:

The FIG. 24 refers to the sealing of the compression chamber (2α) where the rings (23) of the pistons are the same with the rings of the reciprocative motors. The cylindrical surface of the engine-shaft is sliding on the shell of the compression chamber, while o-rings prevent the oil to come inside the compression chamber.

Figure 25:
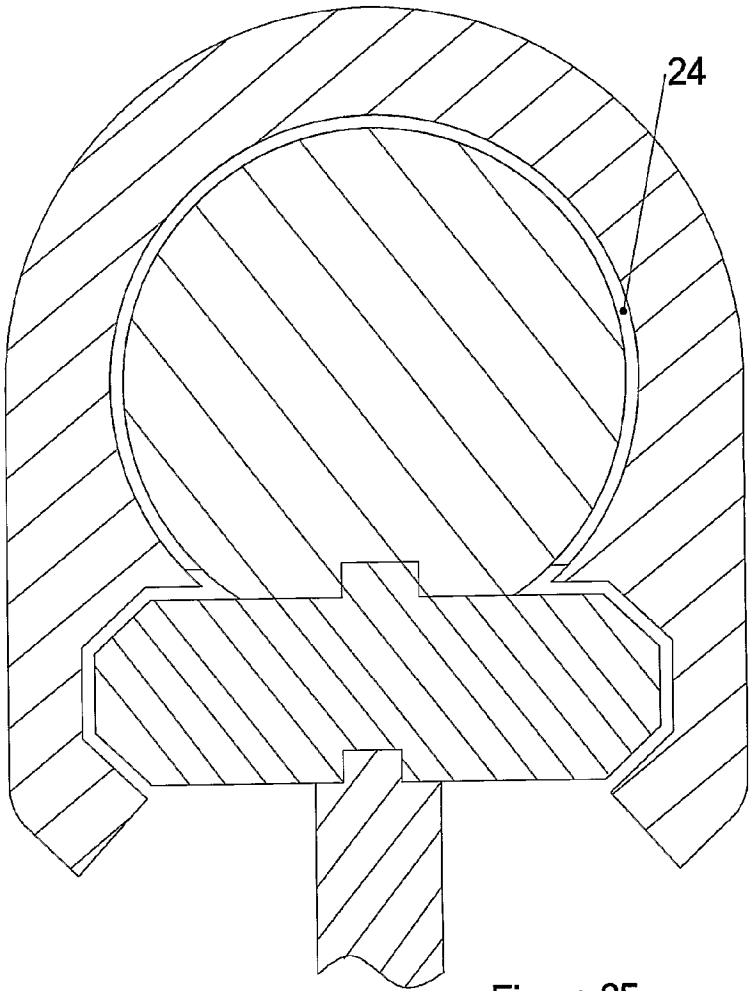
FIG. 25: the sealing of the combustion-chamber and piston.

The FIG. 25 refers to the expansion chamber (1) where the rings (24) of the pistons are the same with the rings of the reciprocative motors. The cylindrical surface of the moving wall is sliding on the shell of the expansion chamber with the aid of oil.

The engine-shaft, the motion-arm and the moving wall has been modulated in such a way that they seem like scotches of variable cross-section that contribute with the corresponding corrugation of the pistons and the moving wall in order to prevent the sliding between each other. In this way, the compression pistons are wedged on the engine-shaft and the expansion piston on the moving wall which is, finally, wedged on an arm. The cross-section of the scotches decreases according to the direction of the movement in order to enforce the wedging as the parts move.

The invention claimed is:

1. A method of operation of an internal combustion engine, said method comprising the steps of:

opening a sliding port of a compression chamber;

moving a compression piston to create an area of low pressure therebehind which forces atmospheric air to enter into said compression chamber through air filters;

covering an entire volume of said compression chamber with atmospheric air;

closing said sliding port of said compression chamber thereby producing a volume of air between said sliding port and said compression piston;

compressing said volume of air by continuing to move said compression piston;

opening a compression chamber valve once a predetermined pressure has been reached and allowing said air to transfer from said compression chamber to a pressure chamber;

storing said air in said pressure chamber;

opening a combustion chamber valve allowing said air to transfer from said pressure chamber to said combustion chamber;

moving a combustion piston to create an area of low pressure therebehind which favors air to enter into said combustion chamber from said pressure chamber;

injecting fuel into said combustion chamber so as to mix with said air;

closing said combustion chamber valve;

igniting said air and fuel and producing an exhaust gas which expands and pushes said expansion piston in a motion that moves said engine shaft which moves said compression piston; and closing said compression chamber valve;

wherein opening and closing of said sliding port, said compression chamber valve and said combustion chamber valve is controlled by at least one of an engine processor and a difference in pressure.

2. The method of operation of an internal combustion engine according to claim 1, wherein said air and fuel is self-ignited by high pressure and temperature inside the combustion chamber after said combustion chamber valve is closed.

3. The method of operation of an internal combustion engine according to claim 1, wherein said air and fuel is ignited by at least one spark plug located in the combustion chamber after said combustion chamber valve is closed.

4. A method of operation of an internal combustion engine, said method comprising the steps of:

opening a sliding port of a compression chamber;

moving a compression piston to create an area of low pressure therebehind which forces mixture of air and fuel to enter into said compression chamber through air filters;

covering an entire volume of said compression chamber with fuel-air mixture;

closing said sliding port of said compression chamber thereby producing a volume of fuel-air mixture between said sliding port and said compression piston; compressing said volume of fuel-air mixture by continuing to move said compression piston;

opening a compression chamber valve once a predetermined pressure has been reached and allowing said fuel-air mixture to transfer from said compression chamber to a pressure chamber;

storing said fuel-air mixture in said pressure chamber;

opening a combustion chamber valve allowing fuel-air mixture to transfer from said pressure chamber to said combustion chamber;

moving a combustion piston to create an area of low pressure therebehind which favors fuel-air mixture to enter into said combustion chamber from said pressure chamber;

closing said combustion chamber valve;

igniting said fuel-air mixture by at least one spark plug located in the combustion chamber and producing an exhaust gas which expands and pushes said expansion piston in a motion that moves said engine shaft which moves said compression piston; and closing said compression chamber valve wherein opening and closing of said sliding port, said compression chamber valve and said combustion chamber valve is controlled by at least one of an engine processor and a difference in pressure.

5. An internal combustion rotary engine comprising:

at least two pistons movable in a circular orbit around a gudgeon of an engine shaft, said at least two pistons being an expansion piston and a compression piston;

at least one combustion chamber being to receive said expansion piston and provide a combustion and expansion process, wherein said combustion chamber has a substantially concentric configuration and at least one exhaust port;

at least one compression chamber being to receive said compression piston and provide an intake and compression process, wherein said compression chamber has a substantially concentric configuration and at least one intake port; and wherein said internal combustion rotary engine further comprising:

at least one pressure chamber interposed between and in fluid communication with said compression chamber and said combustion chamber, wherein said pressure chamber stores at least air under high pressure; and wherein said compression piston's position produces an effective torque because of a minimum torque requirement for the compression of a working medium, due to a minimum radius of rotation of said compression piston around said engine shaft, and a maximum torque production due to a maximum radius of rotation of said expansion piston around said engine shaft.

6. An internal combustion rotary engine comprising:

at least two pistons movable in a circular orbit around a gudgeon of an engine shaft, said at least two pistons being an expansion piston and a compression piston;

at least one combustion chamber being to receive said expansion piston and provide a combustion and expansion process, wherein said combustion chamber has a substantially concentric configuration and at least one exhaust port;

at least one compression chamber being to receive said compression piston and provide an intake and compression process, wherein said compression chamber has a substantially concentric configuration and at least one intake port; and wherein said internal combustion rotary engine further comprising:

at least one pressure chamber interposed between and in fluid communication with said compression chamber and said combustion chamber, wherein said pressure chamber stores at least air under high pressure;

at least one motion arm attached to said engine shaft; and a rotating wall having a ring configuration being attached on a free edge of said motion arm opposite said engine shaft;

wherein said compression piston's position produces an effective torque because of a minimum torque requirement for the compression of a working medium, due to a minimum radius of rotation of said compression piston around said engine shaft, and a maximum torque production due to a maximum radius of rotation of said expansion piston around said engine shaft.

7. The internal combustion rotary engine according to claim 6 further comprising at least one valve for controlling the fluid communication between said pressure chamber and each of said combustion and compression chambers respectively, and a relief valve in said pressure chamber to prevent an increase of pressure inside said pressure chamber due to at least one of hot weather and high operation temperatures, and wherein said at least one valve and said relief valve are controlled by at least one of an engine processor and a difference in pressure.

8. The internal combustion rotary engine according to claim 7, wherein said at least one valve and said relief valve are controlled by pressure differences between said pressure and compression chambers and said pressure and combustion chambers, respectively.

9. The internal combustion rotary engine according to claim 6 wherein said compression and combustion chambers each having a sliding port controlled by an engine processor to open and close so as to determine a compression ratio and an expansion ratio, and wherein timing of said sliding port in said compression chamber determines a compression volume, influencing directly an output power of said internal combustion rotary engine since the timing of said sliding port changes an amount of the used combustion air and fuel, respectively.

10. The internal combustion rotary engine according to claim 6, wherein interior walls of said compression and combustion chambers are cooled by air passed through filters, wherein said air is sucked through wings located on edges of said engine shaft having a hollowed interior, and wherein said air is then accelerated through a developed centrifugal force and by an interior shape of said pistons and motion arm which are hollow having a venturi nozzle configuration.

11. The internal combustion rotary engine according to claim 6, wherein said compression chamber is formed by an outer cylindrical surface of said engine shaft, a compression sliding port, said compression piston, and a stationary toroidal shell attached on a frame of said internal combustion rotary engine.

12. The internal combustion rotary engine according to claim 6, wherein said combustion chamber being formed by a combustion sliding port, said expansion piston, a stationary toroidal shell attached on said frame of said internal combustion rotary engine, and said rotating wall.

13. The internal combustion rotary engine according to claim 6, wherein a motion arm transmits all motion of said engine shaft to said compression piston, and wherein said compression chamber is formed by a stationary shell attachable on a frame of said internal combustion rotary engine and rotating wall having a ring configuration.

14. The internal combustion rotary engine according to claim 6, wherein said motion arm is two motion arms of the same length attached to said engine shaft forming an angle of 180° between them, each of said motion arm having an expansion piston on said free edge dividing the combustion-expansion chamber in to two chambers of equal volume, and wherein each of said combustion-expansion chambers is connected and in fluid communication with said at least one pressure chamber.

15. The internal combustion rotary engine according to claim 7, wherein said motion arm transmits all motion of said expansion piston to said engine shaft, and wherein said combustion chamber is formed by a stationary shell attached on a frame of said internal combustion rotary engine and said rotating wall having said ring configuration, wherein said rotating wall is attached on said free edge of said motion arm that is attached on said engine shaft.

16. An internal combustion rotary engine comprising:

at least one combustion chamber formed by a toroidal shell, said toroidal shell having at least one fuel injector, at least one spark plug, an exhaust, and a sliding port;

at least one compression chamber formed by a toroidal shell, said toroidal shell of said compression chamber having a sliding port;

at least one pressure chamber interposed between and in fluid communication with said compression chamber and said combustion chamber, wherein said pressure chamber stores air under high pressure;

at least one expansion piston having a substantially circular cross-section, wherein said expansion piston received and moved in said combustion chamber;

at least one compression piston having a substantially circular cross-section, wherein said compression piston received and moved in said compression chamber;

a rotatable engine shaft having a cylindrical outer surface;

at least one motion arm attached to said engine shaft, said expansion piston positioned on a free edge of said motion arm opposite said engine shaft, said compression piston positioned adjacent said cylindrical outer surface of said engine shaft and following the rotating motion of said engine shaft;

a rotating wall attached on said free edge of said motion arm, said rotating wall has a ring configuration receivable in said combustion chamber;

at least one valve controlling the fluid communication between said pressure and each of said compression chambers and said pressure and said combustion chamber respectively; and a relief valve in said pressure chamber to prevent an increase of pressure inside said pressure chamber due to at least one of hot weather and high operation temperatures;

wherein said compression and combustion chamber sliding ports are controlled to open and close to provide a compression ratio and an expansion ratio, and wherein timing of said sliding port in said compression chamber determines a compression volume, influencing directly an output power of said internal combustion rotary engine by changing an amount of the used combustion air and fuel, respectively.

17. The internal combustion rotary engine according to claim 16, wherein said at least one valve and said relief valve are controlled by an engine processor.

18. The internal combustion rotary engine according to claim 16, wherein said at least one valve and said relief valve are controlled by pressure differences between said pressure and compression chambers and pressure and combustion chambers, respectively.

19. The internal combustion rotary engine according to claim 16, wherein interior walls of said compression and combustion chambers are cooled by air passed through filters, wherein said air is sucked through wings located on edges of said engine shaft having a hollowed interior, wherein said air is then accelerated through a developed centrifugal force and by an interior shape of said pistons and motion arm which are hollow having a venturi nozzle configuration.

20. The internal combustion rotary engine according to claim 16, wherein said motion arm is two motion arms of the same length attached to said engine shaft forming an angle of 180° between them, each of said motion arm having an expansion piston on said free edge dividing the combustion-expansion chamber in to two chambers of equal volume, wherein each of said combustion-expansion chambers being connected and in fluid communication with said at least one pressure chamber.

* * * * *